US006655539B2

(12) United States Patent
Bertinotti

(10) Patent No.: US 6,655,539 B2
(45) Date of Patent: Dec. 2, 2003

(54) TOWER CRANE WITH COMPOSITE STRUCTURE, SELF-ASSEMBLING, WITH FOLDING AND TELESCOPING TOWER, AND ARM MADE UP OF SEVERAL SECTIONS

(75) Inventor: Piero Bertinotti, Omegna (IT)

(73) Assignee: San Marco International S.r.l., Borgomanero-Novara (IT)

( * ) Notice: Subject to any disclaimer, the term of this patent is extended or adjusted under 35 U.S.C. 154(b) by 0 days.

(21) Appl. No.: 10/052,319

(22) Filed: Jan. 18, 2002

(65) Prior Publication Data

US 2002/0096484 A1 Jul. 25, 2002

(30) Foreign Application Priority Data

Jan. 23, 2001 (IT) ..... MI2001A0116

(51) Int. Cl.[7] ..... B66C 23/42
(52) U.S. Cl. ..... 212/300
(58) Field of Search ..... 212/300

(56) References Cited

U.S. PATENT DOCUMENTS 6,276,541 B1 * 8/2001 Gevaudant ..... 212/300
6,290,078 B1 * 9/2001 Veerchere ..... 212/300

FOREIGN PATENT DOCUMENTS

| | | | |
|---|---|---|---|
| DE | 3245262 | * | 6/1984 |
| DE | 3633582 | * | 10/1986 |
| DE | 2991790 | * | 5/2000 |
| EP | 0 624 542 A2 | | 11/1994 |
| EP | 0 733 584 | | 9/1996 |
| EP | 0 870 726 | | 10/1998 |
| EP | 0 999 171 | | 5/2000 |
| FR | 2 802 908 | | 5/2000 |
| IT | 1 247 274 | | 12/1994 |
| JP | 5-213583 | * | 8/1993 |

* cited by examiner

*Primary Examiner*—Thomas J. Brahan
(74) *Attorney, Agent, or Firm*—Hedman & Costigan, P.C.

(57) ABSTRACT

A tower crane with composite structure, self-assembling, with sections which are hinged together with the use of horizontal hinges, the whole comprising a load-bearing arm (50) made up of several sections (23), (24), (25), (26) hinged together, and a tower composed of at least one pair of sections (20, 21) hinged together (at 12) and at least one section (22) which can be inserted into or telescoped from one of the other sections, and with tie rods (31, 32, 33) which work with the aforesaid arm (50), which arm comprises a first primary section (23), vertically higher at a front part thereof for connecting to a secondary section (24); a secondary section (24) interposed before a second primary section (25), of uniform height; a third primary section (26), hinged at one end (at 16) of its upper surface to the free end of the second primary section (25); actuating means (60, 62) for unfolding and re-folding of the joints between the primary sections (23, 25, 26); and means (68, 70; 32, 33) for re-establishing structural integrity between the first and second primary sections (23, 25) when the arm is in the deployed position.

8 Claims, 11 Drawing Sheets

16

43
41
13
42
29
40
26
25
50
22
23
33
21
30
15
24
12
14
20
28
11
27
17
10

TOWER CRANE WITH COMPOSITE STRUCTURE, SELF-ASSEMBLING, WITH FOLDING AND TELESCOPING TOWER, AND ARM MADE UP OF SEVERAL SECTIONS

This patent refers to a tower crane with composite structure, self-assembling, with folding and then telescoping tower, and arm made up of several folding and unfolding sections.

Cranes are already known which have a self-assembling composite structure in which the vertical element, known as "tower", is composed of a pair of structural sections hinged together, and the horizontal element, known as "arm", is similarly composed of one or more sections hinged together. The sections of the vertical element are, when the crane is down, horizontal and laid down one on top of the other, while with the crane assembled they are vertical and in line with each other so as to form the crane's tower. The sections of the horizontal element are likewise, when the crane is in the down position, horizontal and folded upon each other, and on top of the sections of the vertical element, while when the crane is assembled they are horizontal and in line with each other to form the arm of the crane.

There are various systems for passing from the position where the crane is down and the tower and arm sections are folded and horizontal to that in which the crane is assembled, with the tower sections in line and vertical and the arm sections in line and horizontal; the maximum height that the tower's upper end, and consequently the arm attached to that end, can reach is in any case equal to the maximum length of the two tower sections hinged together.

This limits the use of a crane constructed in this way, since there is no way of reaching heights greater than the sum of the lengths of the tower sections. At the same time, considerations of transporting the disassembled crane prevent the arm sections being much longer than the tower sections, while the cumulative total height of the tower sections and arm sections laid one upon the other cannot, in view of the same considerations, exceed a certain height, thus limiting the number or height of the individual arm sections to be placed one upon the other.

In the case of cranes already known, the raising of the arm into its working position from its position with the crane down is carried out during the stage of lining up and erecting of the tower by means of a suitable relay of struts and tie rods; this generates considerable bending forces in the two tower sections and in the various types of component that may be used for erection of the tower. Furthermore, in known cranes at least one of the hydraulic actuators, preferably installed for the deployment and folding of the crane and of the arm, has a structural function in the deployed machine and cannot, therefore, be replaced in the event of failure while the crane is assembled.

One purpose of the present invention is therefore to create a crane with a self-assembling foldable and telescoping tower and a multi-section arm, to avoid the above-described technical problems.

Another purpose of the present invention is to create a crane of the above type which is particularly simplified in structure and construction, and which would be equally simple and effective in use.

Yet another purpose is to create a crane capable of performing the tasks required of it while still being particularly simple to use.

These purposes have been achieved in this invention with the creation of a crane with a self-assembling foldable and telescoping tower and multi-section arm as set out in the attached claim 1.

Further salient particular characteristics of this invention are covered by the dependent claims.

In particular, the crane in the present invention has a tower of composite structure made of at least one pair of hinged sections consisting of structural members, box girders of square or rectangular cross-section, and a third section inserted into the upper section of the hinged pair, this third section being composed of a single structural member or box girder of square or rectangular cross-section which can be telescoped once the two hinged sections are vertical and lined up, so that the upper end of the tower so formed can reach a greater height than that reachable by the hinged pair of sections alone. Furthermore, the particular small height of the individual arm sections allows a sufficient number of them to be placed one upon the other, when the crane is folded, for the arm to be of considerable length, and longer than can be achieved with other known cranes of the same type, when the crane is assembled.

Furthermore, since in the case of the crane created by this invention the telescoping of the third tower section takes place after the alignment in the vertical position of the pair of hinged sections, and it is only at that stage of telescoping that the arm is raised to its working height, progress is made towards the aim of reducing the bending stresses in the two hinged tower sections and the components used for erecting the tower.

The features, and the advantages, of a crane with self-assembling foldable and telescoping tower and multi-section arm as in this invention will become clearer and more evident from the following description, which is provided merely as an example, and without liming purposes, of an embodiment with reference to the attached drawings, in which.

It should be made clear first of all that the tower, notwithstanding that it is an integral part of the present invention, is the subject of two Italian patent applications, MI2000A002661 and MI2000A001062, which illustrate two embodiments thereof. The unfolding and re-folding arrangement that operates between the second and third primary arm sections, described below, likewise makes use of the finding described in the Italian Utility Model No. 218897.

Once that is clear, it may be noted that a crane has been constructed with a tower as described above and a multi-section arm with sections of limited height supported by struts and tie rods in such a way that no fewer than three arm sections can, when the crane is disassembled and the tower and arm are folded, be laid one on another and all together on top of the two hinged tower sections, in such a way that the overall height of the disassembled and folded crane is relatively low and not such as to hinder its transport. The finding that is the subject of this present invention, as well as allowing a considerable height to be reached and providing the other advantages inherent in the tower's particular features, also makes it possible, when all arm sections are deployed, to reach a considerable arm length, which increases the machine's capabilities of use to a significant extent.

Figure 1:
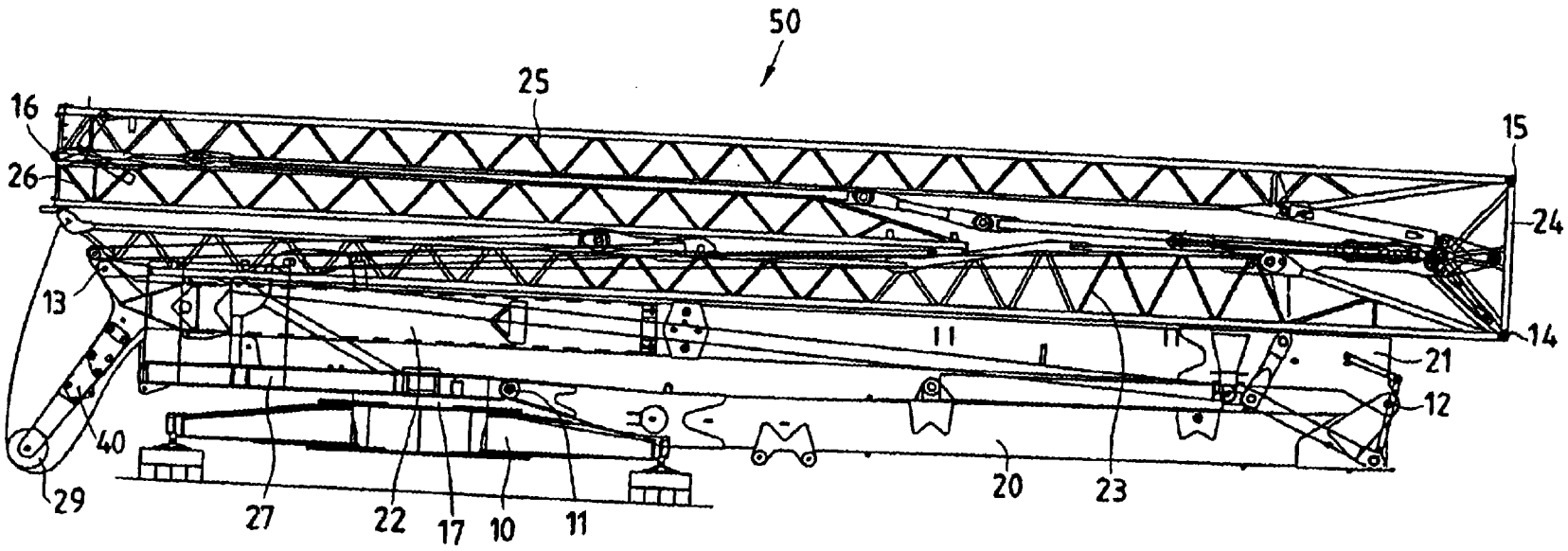
FIGS. 1 to 5 are schematic elevation side views of the self-assembling crane according to the invention, in which the assembling of the tower is essentially shown.
Figure 2:
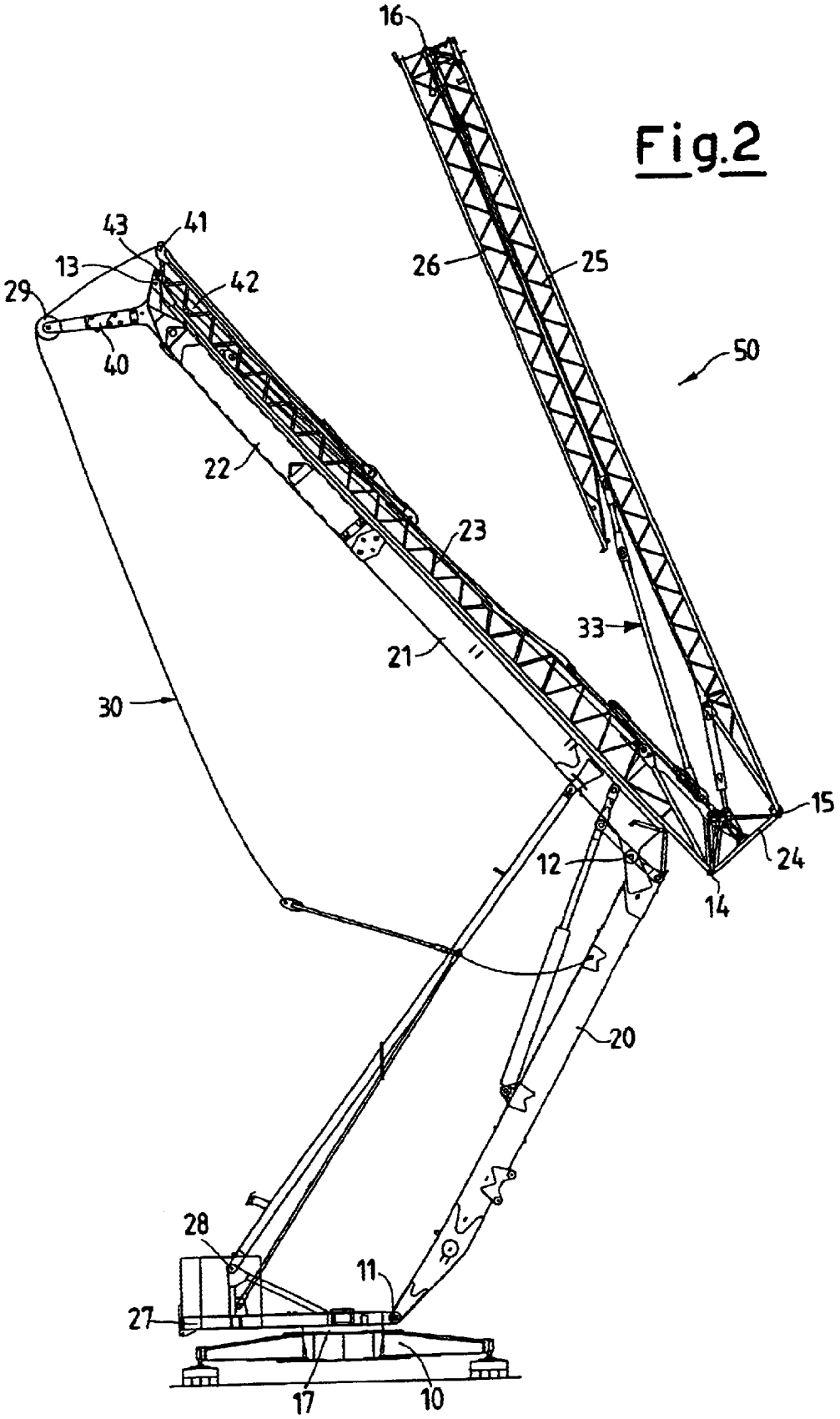
Figure 3:
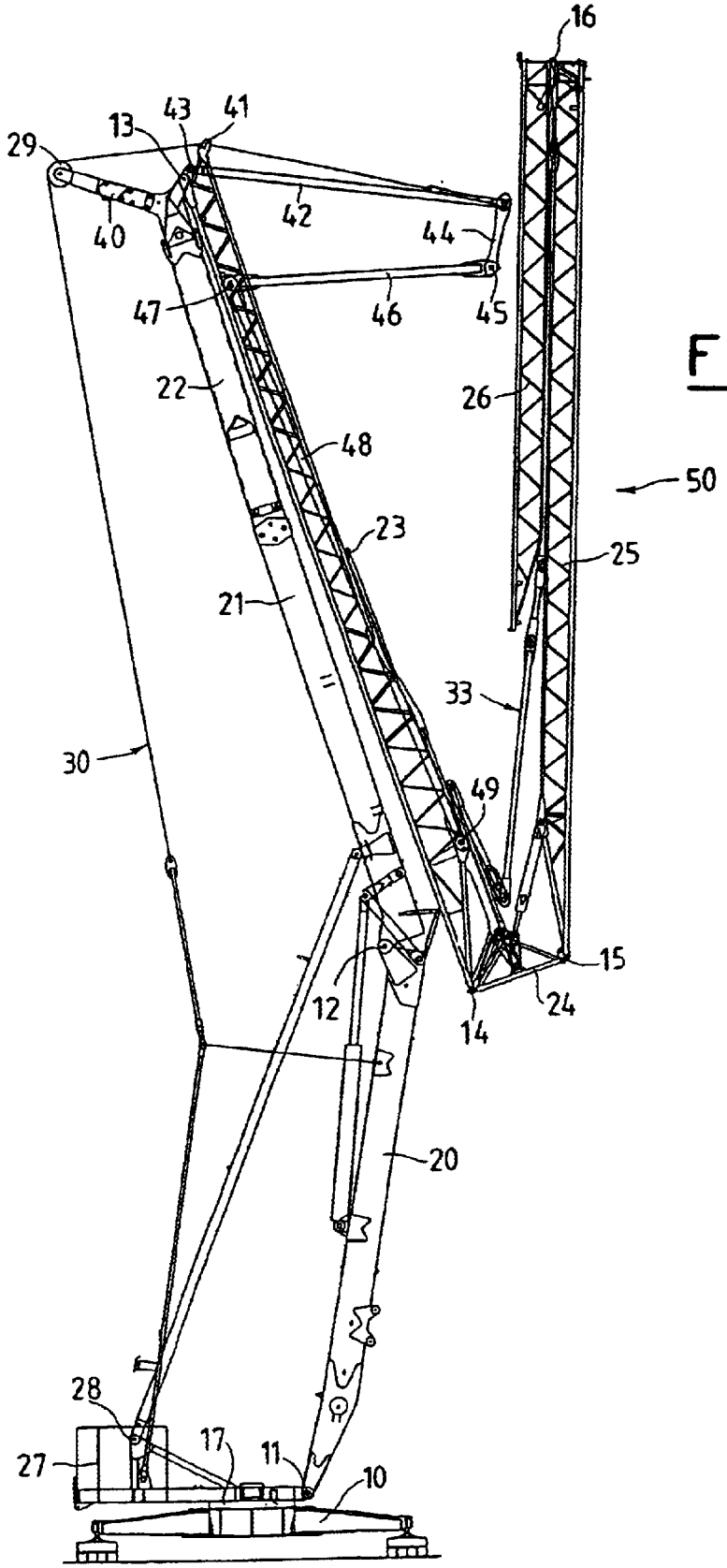
Figure 5:
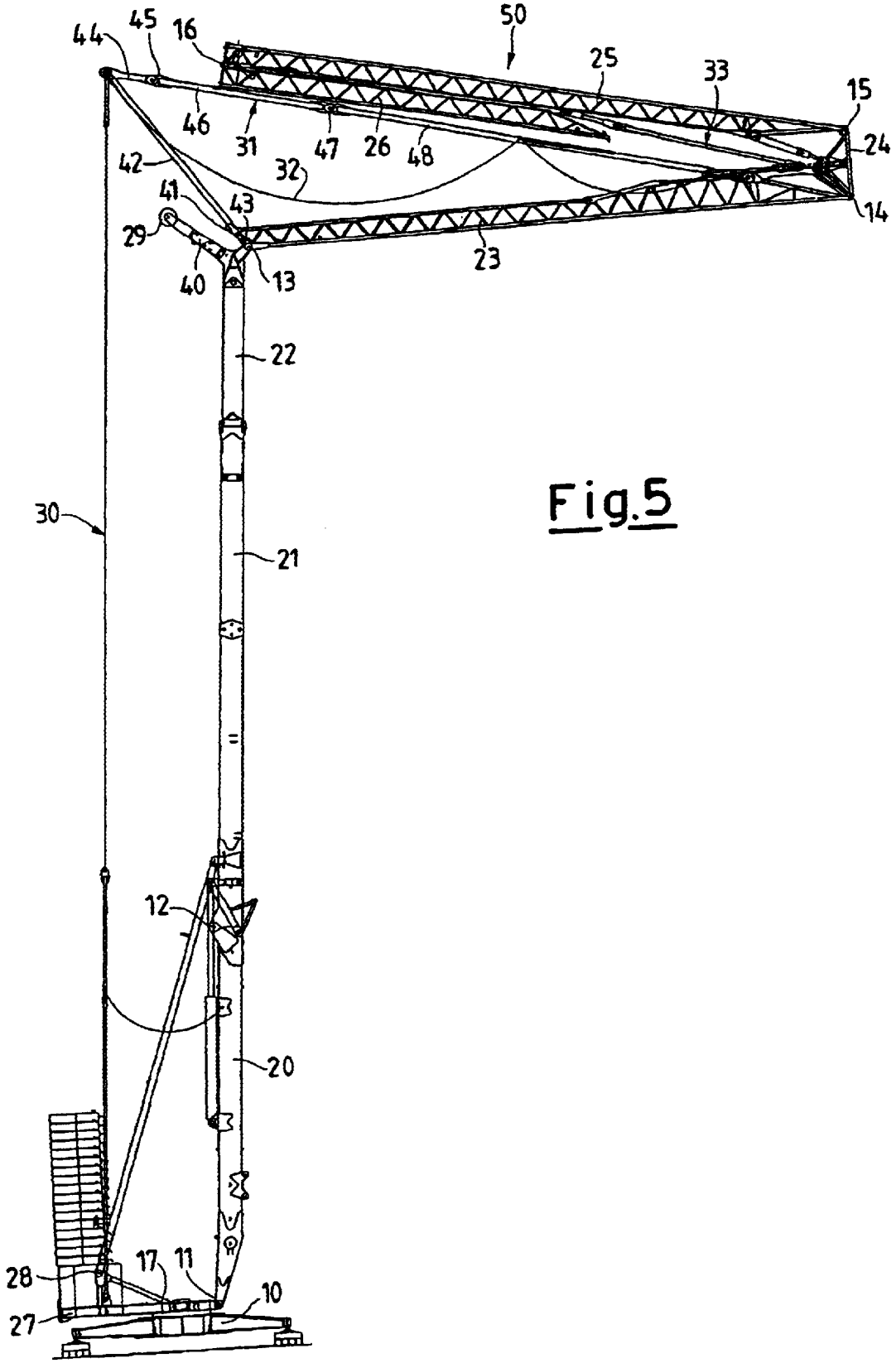
Figure 6:
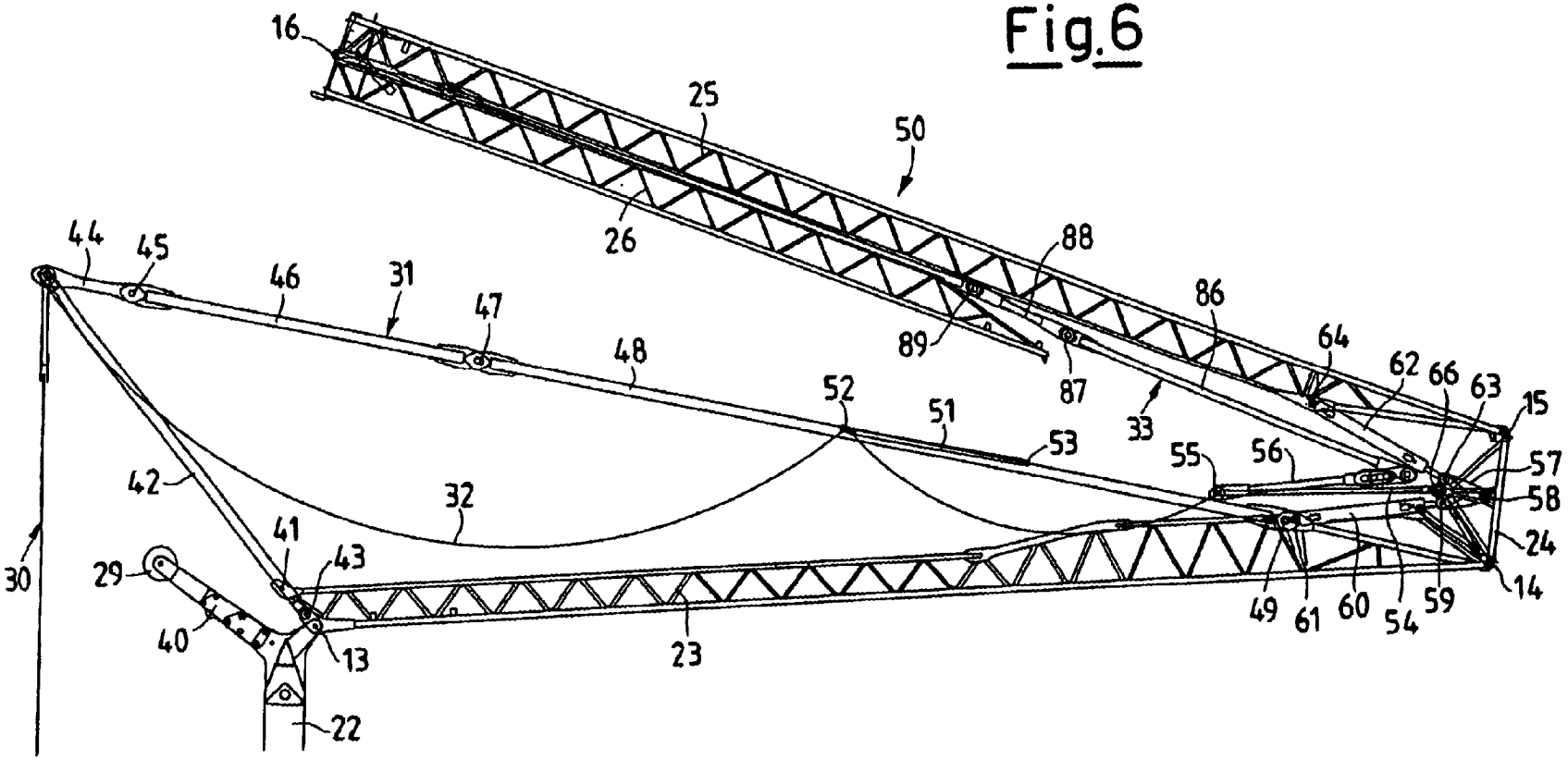
FIGS. 6 to 8 are schematic elevation side views showing the unfolding of the upper arm of the crane shown in FIG. 1.
Figure 7:
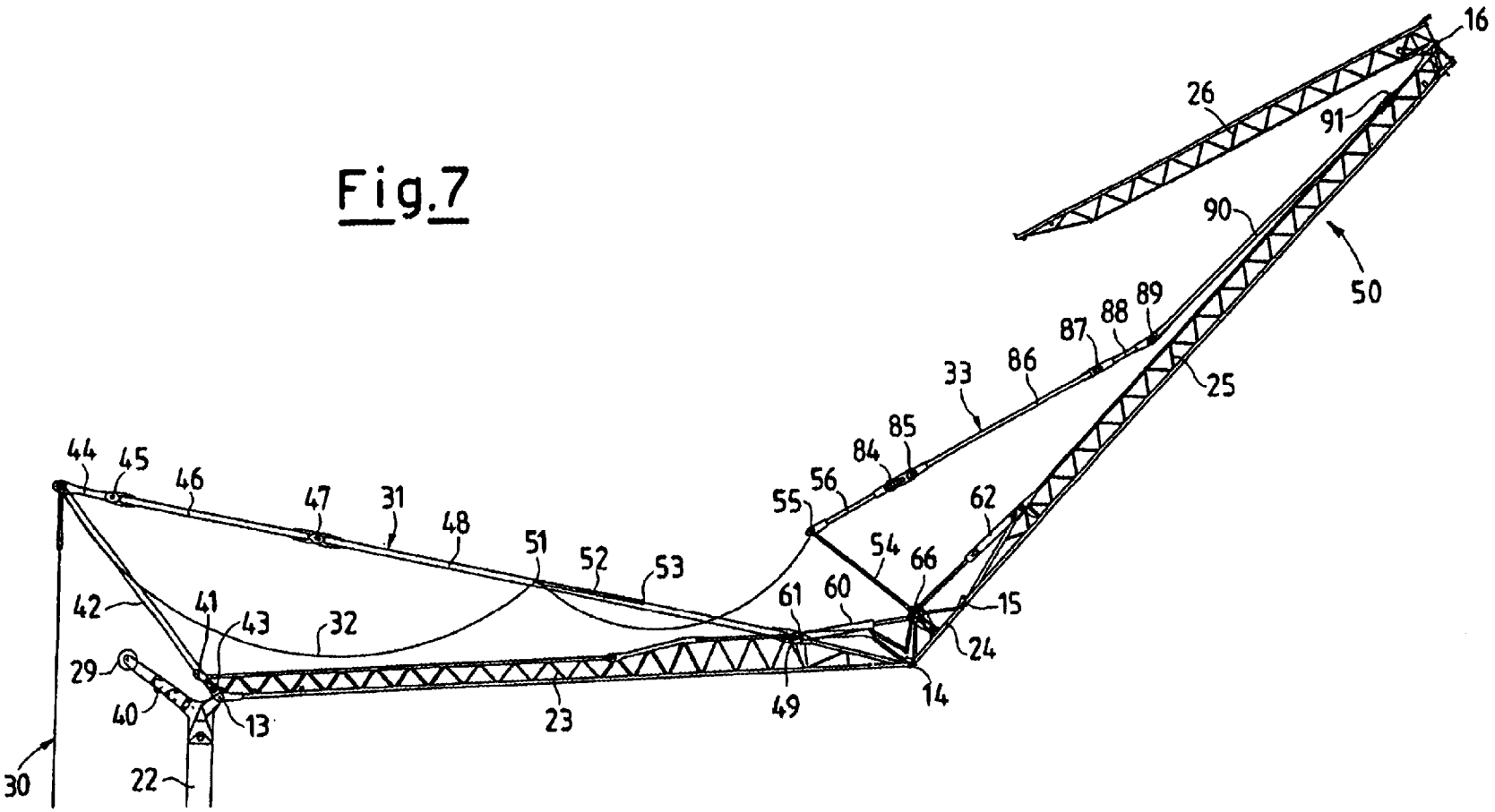
Figure 8:
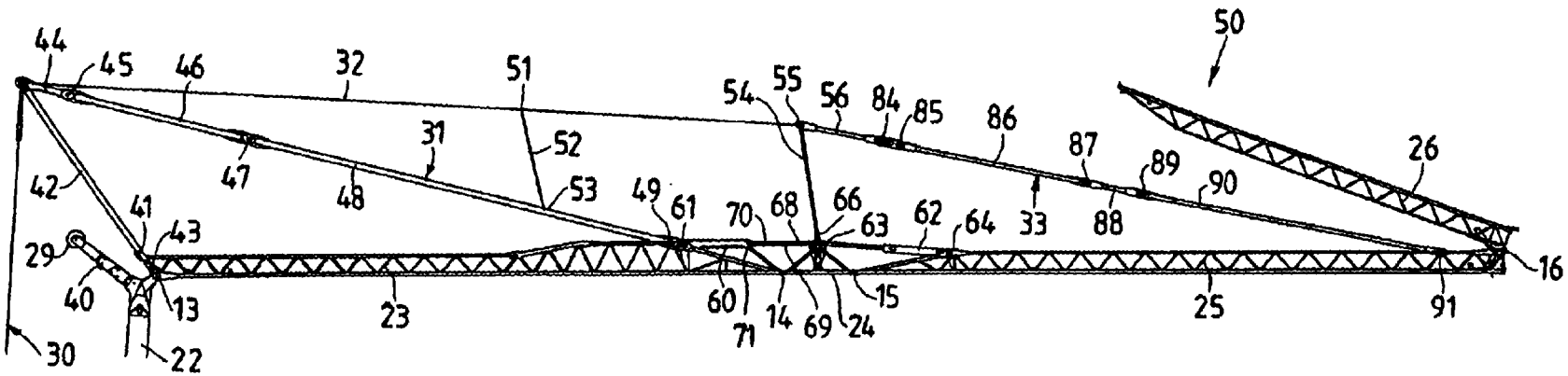
Figure 9:
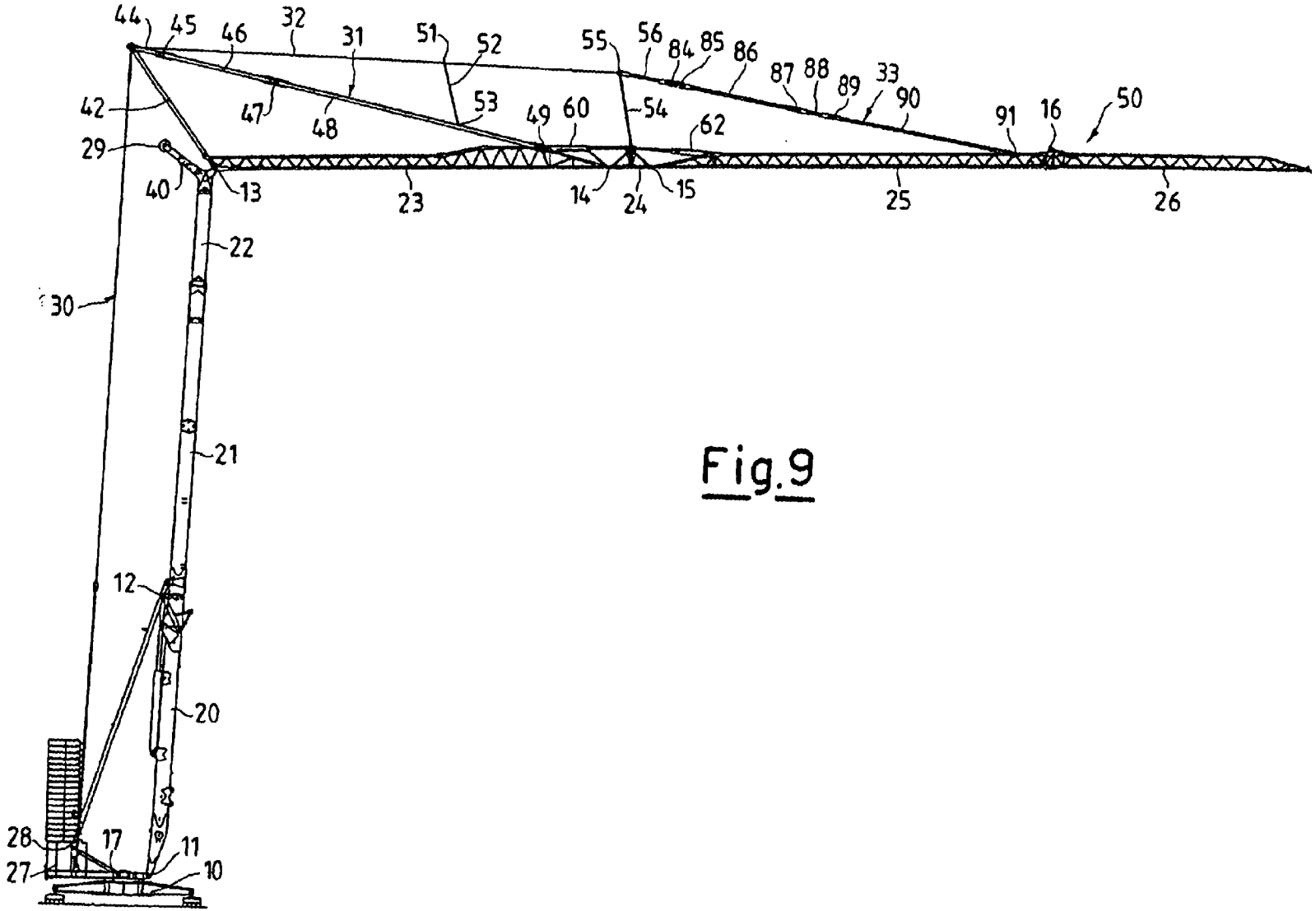
FIG. 9 is an elevation side view on a smaller scale of the crane in the fully assembled position.
Figure 10:
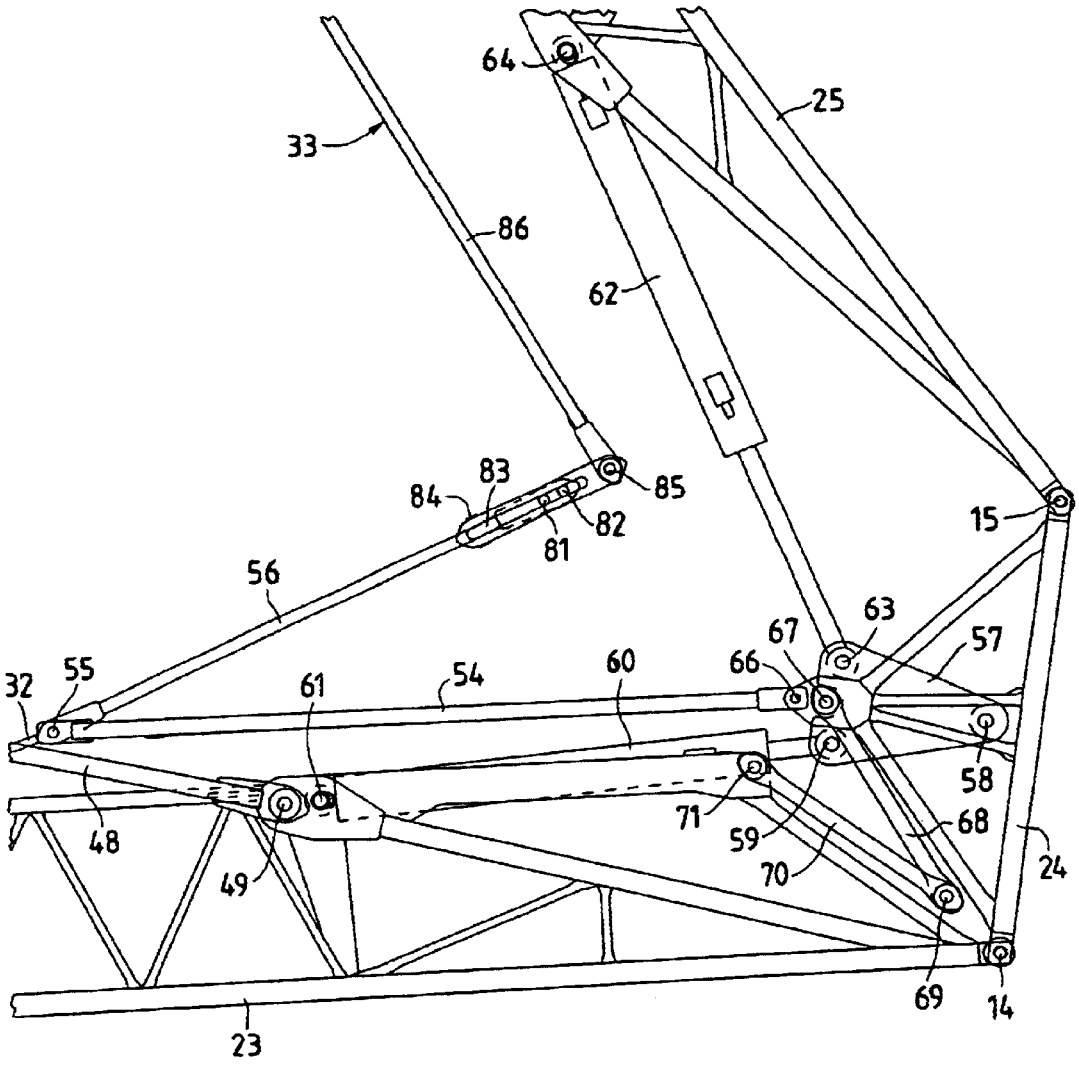
FIGS. 10 and 11 show the linkages between the first primary arm section, the intermediate element and the second primary arm section, respectively at a half-aligned stage and at the fully aligned stage.
Figure 11:
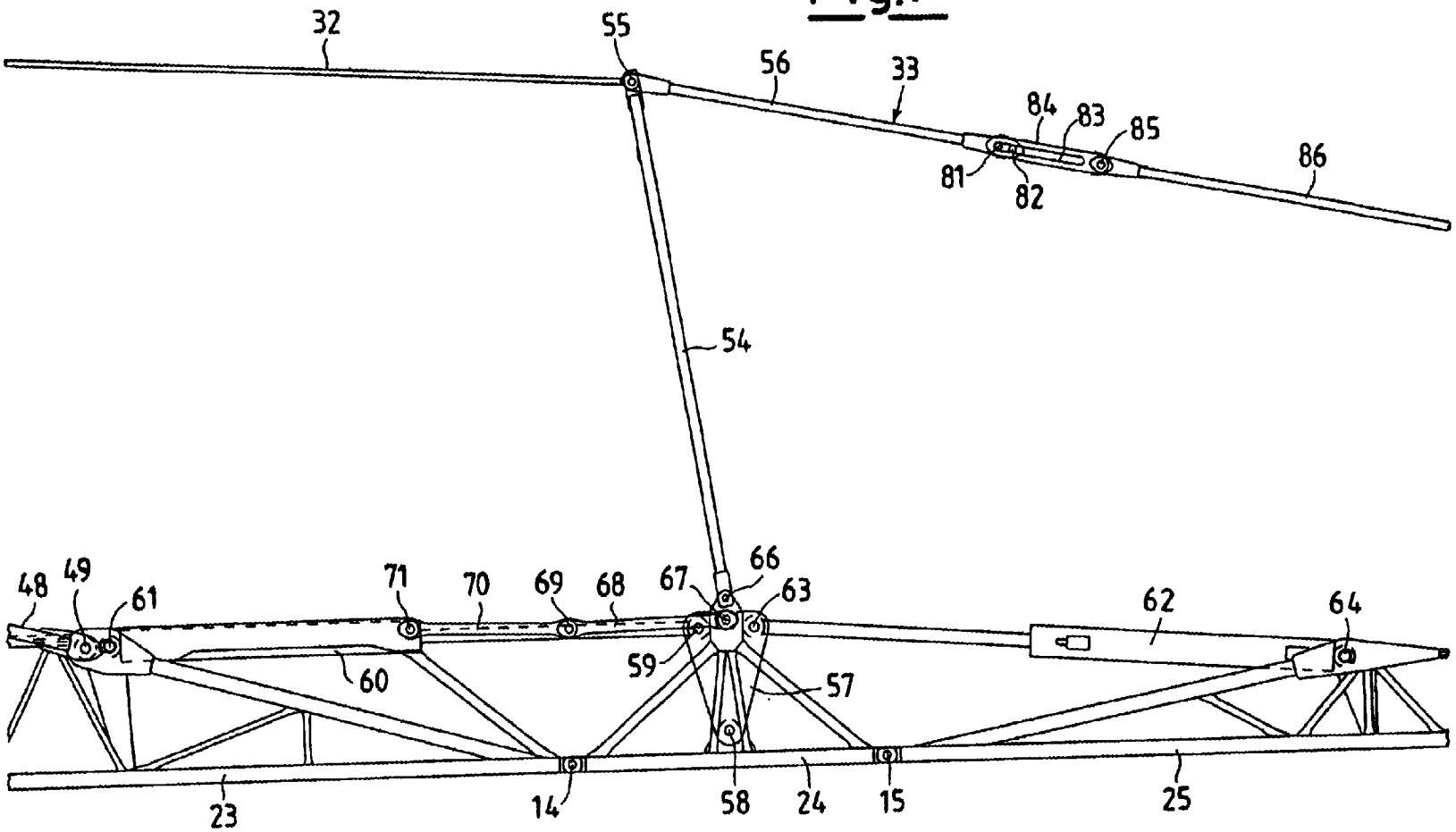

In detail, it will be noted that in FIG. 1, the crane is in the fully folded state, with the base 10 resting on the ground. FIGS. 2 and 3 show the crane with the tower in various stages of erection, until in FIG. 4 we see the two tower sections aligned, with the third section as yet still fully inserted inside them. FIG. 5 then shows the two tower sections aligned and the third section now fully telescoped, while the arm sections are still partly folded up. FIGS. 6, 7 and 8 are schematic views of a self-assembling crane according to the present invention, with the arm, tie rods and booms shown at three successive stages of unfolding, until in FIG. 9 we can see the crane fully assembled in its working position. Lastly, FIGS. 10 and 11 show, as already said, the linkages between the first primary arm section, the intermediate element and the second primary arm section, at a half-aligned stage and at the fully aligned stage.

As can be seen from these figures, this invention refers to a crane with self-assembling tower with composite structure with sections hinged together with horizontal hinges, referenced with the numerals 11, 12, 13, 14, 15 and 16. It is composed of a tower made up of two sections 20 and 21, hinged together at 12, and a third section 22 which is inserted into and can be telescoped from the upper section 21 of the two hinged sections. A load-bearing arm 50 is composed of a number of sections; it is made of a first primary section 23, one end of which is hinged at 13 at its under surface to the upper end of the telescoping section 22 of the tower. There follows a relatively short secondary section 24, one end of which is hinged at 14 at its under surface to the free end of the first primary section 23; then there is a second primary section 25, one end of which is hinged at 15 at its under surface to the free end of the secondary section 24; and finally a third primary section 26, one end of which is hinged at 16 at its upper surface to the free end of the second primary section 25. All sections of the arm have a considerably reduced height so as to allow for the superimposition, when the crane is down, of at least three sections; only the first primary section 23 has, at its front end in the vicinity of its end hinge 14, a greater vertical height so as to accommodate the motor, with motor reducer, that moves the truck.

The lower part of the tower, 20, is in turn hinged at its bottom end 11 to a base structure shown altogether as 27, with a turntable 17, this turntable being solidly attached to the base 10. This base structure 27 has the usual controls for unfolding and re-folding the whole crane, not shown in detail, which act via a flexible tie rod 30 running up beside the tower essentially at the opposite side with respect to the arm, and flexible tie rods 31 and 32 running to the arm from above.

The tie rods, the parts of the base structure, and parts of the crane structure, form an articulated quadrangle.

Figure 4:
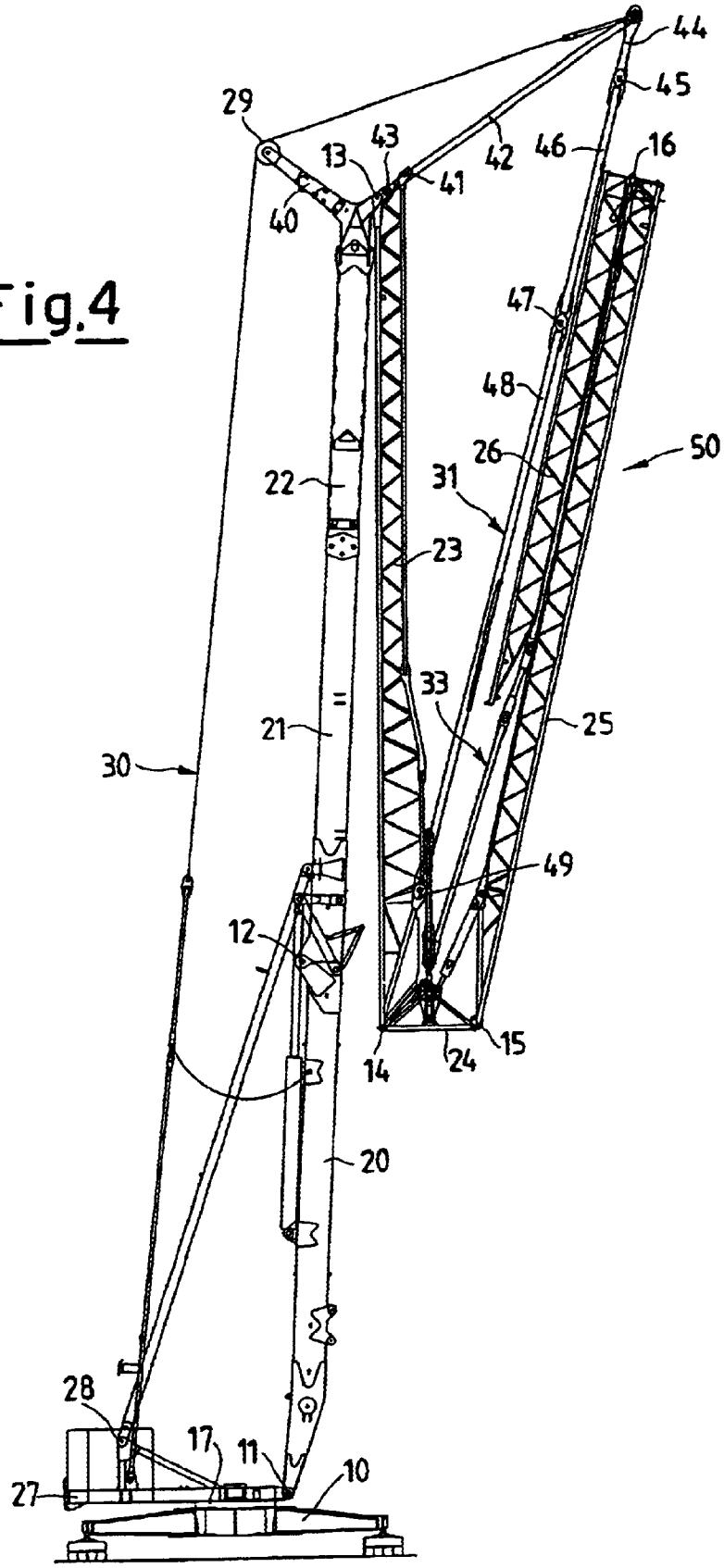

The two hinged parts of the tower 20 and 21 move from their disassembled position shown in FIG. 1 horizontal and one above the other to a near-vertical and aligned position shown in FIG. 4, passing through a series of intermediate positions, two of which are shown in FIGS. 2 and 3.

In the intermediate position shown in FIG. 2, the flexible tie rod 30, which may be made up of more than one length, is attached with a hinge at 28 to the base structure 27, and passes over a large pulley 29 located at the end of a boom 40. The boom is rigidly attached to the upper end of the third tower section 22, and rests against a roller 41 hinged at the end of the first arm section 23 at its upper surface. As can be seen better in FIG. 3, the other end of tie rod 30 is hinged to tie rods 31 and 32 and to the end of another boom 42, this boom being in turn hinged at 43 to the upper end of the tower 22. As the two hinged tower sections 20 and 21 are raised by degrees, so tie rod 30 comes under progressively greater tension.

Before the raising of the two tower sections 20 and 21 can make tie rod 30 pull boom 42 so that it rotates around hinge 43, the second and third arm sections 25 and 26 must be unfolded enough, moving them away from the first section 23 by a distance necessary and sufficient to allow boom 42 to turn around hinge 43 without the end of that boom 42 fouling the third arm section 26. The arrangements for unfolding all the arm sections are described below.

The raising of the two tower sections 20 and 21 makes tie rod 30 pull boom 42 so that it rotates around hinge 43, pulling tie rod 31 tight. This tie rod is made of three lengths: the first 44 is shorter and attached to boom 42 while the second 46 is roughly the same length as boom 42 and is attached at 45 to the first length of tie rod 44; a third length, 48, is attached at 47 to the second length 46 and at its other end at 49 to the first primary arm section 23 at that section's upper surface.

When tie rod 31 is pulled by the rotation of boom 42, the time comes for unfolding the second arm section 25 and the third arm section 26 until they lean on tie rod 33. The unfolding of the two tower sections 20 and 21 continues, and when the two hinged sections 20 and 21 are in line and vertical or leaning slightly in the direction away from tie rod 30, as shown in FIG. 4, the telescopic tower section 22 is still fully inside tower section 21; the load-bearing arm 50, hinged at 13 to the upper end of tower section 22, is vertical and almost entirely supported by tower sections 20 and 21, with tie rods 30 and 31 both under tension.

In the final stage of the crane tower's erection, tower section 22 is telescoped from hinged tower section 21 as shown in FIG. 5, and the control devices for this telescopic operation are illustrated in the two patent applications mentioned above. As tower section 22 is telescoped, the tension of tie rods 30 and 31 makes the load-bearing arm 50 turn around the hinge 13 while the arm rises, until it reaches a position of horizontality or is slightly higher at the end further from the tower, as shown in FIG. 6, just as tower section 22 reaches its fullest telescoping from tower section 21. Tower section 22 is fixed, by conventional means, in this position of maximum telescoping at which the crane can be used for lifting loads.

One end of a strut 54 is hinged at 66 onto the upper part of the secondary section 24 of the arm 50, while the other end of strut 54 is hinged at 55 to the end of flexible tie rod 33 and to the end of flexible tie rod 32, which consists of a metal cable. Approximately two thirds of the way along its total length, tie rod 32 is fixed to the end 51 of a strut 52, whose other end is hinged at 53 to length 48 of tie rod 31. Details of the device for aligning the second primary arm section 25 and the secondary arm section 24 with the first primary arm section 23 can be seen more readily in FIGS. 10 and 11.

The end of a connecting rod 57 is attached by a hinge 58 to the secondary arm section 24, hinge 58 being located half-way along the under side of section 24, between hinges 14 and 15 and close to its under side; the rotation of rod 57 is restricted by a restrainer cable fixed with some degree of clearance at the other end of rod 57 by a loose hinge 67 which is fixed to the upper part of the secondary arm section 24.

A hydraulic actuator 60 is hinged at one end 61 on the structure above the first primary arm section 23 and at the other at 59 on the upper part of rod 57. A second hydraulic actuator 62 is hinged at one end 64 on the second primary arm section 25 and at the other at 63 on the upper part of rod 57. A pair of connecting rods of equal length 68 and 70 are hinged at 69, the other end of rod 70 being hinged at 71 on the first primary arm section 23 and the other end of rod 68 being hinged at 67 on the upper part of the secondary section 24.

FIG. 6 shows the initial stage of aligning the primary section 23, the secondary section 24 and the primary section 25 of the arm 50. Hydraulic actuator 60 operates to turn the secondary section 24 of the arm 50 around hinge 14, which is at the end of the first primary section 23; hydraulic actuator 62 operates likewise to turn the second primary section 25 of the arm 50 around hinge 15, which is at the end of the secondary section 24. As the secondary section 24 of the arm turns around hinge 14, rods 68 and 70 turn around hinge 69 which links them together, while the end of rod 68 attached at 67 to the upper part of arm section 24 moves in accordance with the turning of that secondary arm section 24 around hinge 14.

FIG. 7 shows a later intermediate stage in the alignment of the primary sections 23 and 25 of the arm 50 and its secondary section 24 of the arm 50. The flexible tie rod 33 is composed of an initial rigid length 56 slightly shorter than strut 54, this length 56 being attached to strut 54 by a hinge at 55 and also to flexible tie rod 32. At the other end of this first length 56 of tie rod 33 are two parallel longitudinal openings between which are two knuckle pins 81 and 82; a short plate 84 has a slot 83 within which the movement of knuckle pins 81 and 82 is constrained, thus allowing in a certain degree the sleeve slinding of the plate 84 in the direction of the axis of the first section 56; the other end of said plate 84 being hinged at 85 to a second portion 86 of the tie rod 33 of relatively considerable lenght. The movement of plate 84 onto knuckle pins 81 and 82 is designed to facilitate the unfolding and re-folding of the lengths of tie rod 33 during the unfolding and re-folding of the crane arm 50. A relatively short secondary length 88 of tie rod 33 is hinged at 87 to the second portion 86 and is hinged in 89 to the third length 90 of tie rod 33, this third length 90 being hinged at 91 to the upper surface of the second primary arm section 25 in the vicinity of its end and of hinge 16.

An arm section 24 turn s around hinge 14 and section 25 turns around hinge 15, tie rod 33 is brought into tension, and strut 54 is raised by the force of this tension in tie rod 33, turning around hinge 66; as section 24 continues to turn around hinge 14, and section 25 around hinge 15, and strut 54 around hinge 66, so the steel cable flexible tie rod 32 comes into tension, which in turn makes strut 52 turn around hinge 53, since strut 52 is rigidly attached at point 51 to flexible tie rod 32.

FIG. 8 shows the final position in which sections 23, 24 and 25 of the arm 50 are aligned, while FIG. 11 gives a clearer idea of the details of the sections 23, 24 and 25, which are joined by hinges 14 and 15. When hydraulic actuator 60 is on the point of reaching its end-of-stroke position, and the secondary arm section 24 is in line with the first primary section 23, a bracket 70 linked by a hinge 71 to the first primary arm section 23, and another bracket 68 linked by a hinge 67 to the secondary section 24, the two brackets 70 and 68 being joined together by hinge 69, are brought into tension, preventing any further turning of secondary section 24 around hinge 14, and performing the function of supporting section 24; the attachment hinge 61 of hydraulic actuator 60 has a slightly elongated hole, allowing that actuator 60 to reach its end position without putting any force on the secondary section 24 and without doing any structural duty of supporting section 24.

When hydraulic actuator 62 is on the point of reaching its end-of-stroke position, and the second primary arm section 25 is in line with the secondary section 24, tie rods 32 and 33 are brought into tension. The tension of the tie rods 32 and 33, via boom 54, prevents any further turning of second primary arm section 25 around hinge 15, so that tie rods 32 and 33 perform via boom 54 the function of supporting section 25; the attachment hinge 64 of hydraulic actuator 62 has a slightly elongated hole, allowing that actuator 62 to reach its end position without putting any force on second primary section 25 and without doing any structural duty of supporting section 25.

Lastly, the turning of the third primary arm section 26 around hinge 16, and the alignment of that section 26 with sections 23, 24 and 25 of the arm 50, are achieved by means of devices already known, such as hydraulic actuators.

This completes the description of the procedure for erecting the crane with, first, complete deployment of the tower and then of the arm; it should be made clear that the crane which is the subject of this invention can be used either with the arm 50 fully deployed as explained above or with the third arm section 26 folded and resting against the pull of tie rod 33, or even with the second arm section 25 and the third arm section 26 both folded and resting against the pull of tie rod 31: this configuration is illustrated in FIG. 5.

The procedure for disassembling the crane, with full folding first of the arm and then of the tower, involves carrying out the erection operations described, in reverse.

In this way a crane has been created with a composite tower and automatic erection, whose tower is composed of at least three sections and whose arm is composed of a number of sections which can be folded and unfolded in the same direction of rotation.

The advantages of a crane using the present invention are clear to see. The tower in at least three sections two hinged and the third telescopical, and the arm sections of which only the first is of smaller vertical height, hinged together and capable of being unfolded and of being placed one upon the other, make it possible to achieve the two-fold result of having a crane of considerable size when deployed and limited size when folded up in its transporting configuration. None of the hydraulic actuators used for the deploying of the machine's sections does any structural duty once the machine has been deployed; in the event of breakdown in any of the hydraulic actuators, therefore, these can be replaced even while the machine is assembled, using suitable means of access.

What is claimed is:

1. A tower crane comprising sections hinged together with horizontal hinges, said tower crane comprising a load-bearing arm (50) made up of sections (23, 24, 25, 26) hinged together, and a tower comprising at least one pair of sections (20, 21) hinged together (12) and a third tower section (22) which is telescoped into one of said at least one pair of sections (20, 21); said tower being equipped with mechanisms enabling said pair of sections (20,21) to be set up vertically and taken down again to a horizontal position and said third tower section being adapted to be telescoped out of one of said pair of sections (20,21); said tower being hinged at its lower end (11) to a base structure (27) having a turntable (17), said tower having control means for the unfolding and re-folding of said crane by means of a series of flexible tie rods (30) running vertically along said tower and having above the load-bearing arm (50), tie rods that are hooked into the load-bearing arm (50) from above, said tie rods forming, together with parts of the base structure and the sections (20, 21 and 22) of the tower, an articulated quadrangle, with tie rods (31, 32, 33) which work with the aforesaid arm (50), which arm is characterized by the following features:

a first primary section (23), hinged (13) at a first end of said first primary section to one side of the tower, and at a position on a second end of said first primary section (23) that is vertically higher than said first end, a hinge (14) which links said first primary section to a secondary section (24) that is adapted to allow the installation of a truck moving motor reducer, said secondary section (24) being hinged at a first end to said first primary section (23) and at a second end (15) hinged, to a second primary section (25) said second primary section (25) having a first end and a second end, said second primary section (25) being of uniform height, a third primary section (26), hinged at a first end (16) at its upper surface to the second end of said second primary section (25)

actuating means (60, 62) for unfolding and re-folding the joints between the aforesaid first, second and third primary sections (23, 25, 26)

means (68, 70, 32, 33) for providing structural integrity between said first and second primary sections (23, 25) when the load-bearing arm (50) is in the unfolded position.

2. The tower crane, according to claim 1, wherein said means of providing structural integrity between said first and second primary sections (23, 25), are first and second connecting rods (68, 70) of equal length, joined together at one end with a hinge (69) and joined at the opposite ends with hinges, in the case of said second connecting rod (70) to the aforesaid first primary section (23) by a pin (71) and, in the case of said first connecting rod (68) to an upper part of the aforesaid secondary section (24) by a pin (67) together with flexible tie rods (32, 33) arranged between a boom (42) at the top of said tower and the second end of said second primary section (25).

3. The tower crane according to claim 1 wherein said actuating means (60, 62) for unfolding and re-folding of the aforesaid first, second and third primary portions (23, 25, and 26) are hydraulic actuators.

4. The tower crane according to claim 1 wherein said tie rods which work with the load-bearing arm (50) comprise a first tie rod (31) composed of three lengths, of which one short length (44) is attached to the boom (42) which extends from said section (22) of said tower, a second length (46) having a length that is approximately as long as said boom (42), and a third length (48) attached to said first primary section (23) of the load-bearing arm (50) at its upper surface; and flexible tie rods (32, 33) arranged between said boom (42) and said second primary section (25).

5. A tower crane according to claim 4 wherein a further strut (54) is arranged between said flexible tie rods (32, 33) and said secondary section (24) of the load-bearing arm (50).

6. The tower crane according to claim 4 wherein at least one length of said flexible tie rods (32, 33) consists of a flexible metal cable.

7. The tower crane according to claim 6 wherein additional strut (52) having a first end and a second end, said first end being hinged to flexible tie rod (32) at hinge (51) which is at a point that is approximately two thirds of the length of said flexible tie rod (32) from boom (44); and said second end of said additional strut (52) being attached by a hinge (53) to said first tie rod (31).

8. A tower crane comprising sections hinged together with horizontal hinges, said tower crane comprising a load-bearing arm (50) made up of sections (23, 24, 25, 26) hinged together, and a tower comprising at least one pair of sections (20, 21) hinged together (12) and a third tower section (22) which is telescoped into one of said at least one pair of sections (20, 21); said tower being equipped with mechanisms enabling said pair of sections (20,21) to be set up vertically and taken down again to a horizontal position and said third tower section being adapted to be telescoped out of one of said pair of sections (20,21) said tower being hinged at its lower end (11) to a base structure (27) having a turntable (17), said tower having control means for the unfolding and re-folding of said crane by means of a series of flexible tie rods (30) running vertically along said tower and having above the load-bearing arm (50), tie rods that are hooked into the load-bearing arm (50) from above, said tie rods forming, together with parts of the base structure and the sections (20, 21 and 22) of the tower, an articulated quadrangle, with tie rods (31, 32, 33) which work with the aforesaid arm (50), which arm is characterized by the following features:

a first primary section (23), hinged (13) at a first end of said first primary section to one side of the tower, and at a position on a second end of said first primary section (23) that is vertically higher than said first end, a hinge (14) which links said first primary section to a secondary section (24) that is adapted to allow the installation of a truck moving motor reducer, said secondary section (24) being hinged at a first end to said first primary section (23) and at a second end (15) hinged, to a second primary section (25) said second primary section (25) having a first end and a second end, said second primary section (25) being of uniform height, a third primary section (26), hinged at a first end (16) at its upper surface to the second end of said second primary section (25)

actuating means (60, 62) for unfolding and re-folding the joints between the aforesaid first, second and third primary sections (23, 25, 26)

means (68, 70, 32, 33) for providing structural integrity between said first and second primary sections (23, 25) when the load-bearing arm (50) is in the unfolded position, said third primary section (26) being adapted to be folded into a position where it is between said first primary section and said second primary section.

* * * * *